US010442059B2

(12) United States Patent
Milligan et al.

(10) Patent No.: US 10,442,059 B2
(45) Date of Patent: Oct. 15, 2019

(54) SOCKET WITH FOUR POINT DRIVE

(71) Applicant: Wright Tool Company, Barberton, OH (US)

(72) Inventors: Kenneth R. Milligan, Uniontown, OH (US); Terry G. Taylor, Copley, OH (US)

( * ) Notice: Subject to any disclaimer, the term of this patent is extended or adjusted under 35 U.S.C. 154(b) by 1407 days.

(21) Appl. No.: 14/211,031

(22) Filed: Mar. 14, 2014

(65) Prior Publication Data

US 2014/0260825 A1 Sep. 18, 2014

Related U.S. Application Data

(60) Provisional application No. 61/794,415, filed on Mar. 15, 2013.

(51) Int. Cl.
*B25B 13/06* (2006.01)
*B25B 23/00* (2006.01)

(52) U.S. Cl.
CPC ..... *B25B 13/06* (2013.01); *B25B 13/065* (2013.01); *B25B 23/0035* (2013.01)

(58) Field of Classification Search
CPC .... B25B 13/065; B25B 13/06; B25B 23/0035
See application file for complete search history.

(56) References Cited

U.S. PATENT DOCUMENTS 38,914 A 6/1863 Richardson
3,466,956 A 9/1969 Bowers
3,675,516 A 7/1972 Knudsen et al.
4,598,616 A * 7/1986 Colvin ..... B25B 13/065 81/124.3
4,882,957 A 11/1989 Wright et al.
4,930,378 A * 6/1990 Colvin ..... B25B 13/065 411/403
5,284,073 A * 2/1994 Wright ..... B25B 13/065 81/121.1
5,481,948 A * 1/1996 Zerkovitz ..... B25B 13/04 81/121.1
6,626,067 B1 9/2003 Iwinski et al.
(Continued)

OTHER PUBLICATIONS

International Search Report dated Jul. 29, 2014 for international application PCT/US2014/027223.

*Primary Examiner* — Bryan R Muller
(74) *Attorney, Agent, or Firm* — Walter | Haverfield LLP; Sean F. Mellino; D. Peter Hochberg

(57) ABSTRACT

An improved socket having a drive end opening being so dimensioned for receiving a drive anvil, the opening comprising a plurality of bounding surfaces parallel to a central axis and being disposed in diametrically opposed pairs about the axis, where the diametrically opposed pairs of bounding surfaces include: at least two pairs of flat side surfaces being parallel to each other about the central axis; at least two pairs of curved recess surfaces forming respective inner corners of the drive end opening; and adjacent pairs of outwardly diverging transition surfaces transitioning between respectively adjacent pairs of the flat side surfaces and the curved recess surfaces. The improved socket increases corner radius for minimizing stress concentration at the corners and provides outwardly diverging transition surfaces for relocating the areas of maximum stress away from the corners.

1 Claim, 8 Drawing Sheets

(56) References Cited

U.S. PATENT DOCUMENTS 6,898,999 B1 5/2005 Hsien
7,406,895 B2 * 8/2008 Hu ..... B25B 13/065
81/121.1

* cited by examiner

| STANDARD SQUARE SIZE | DRIVE SQUARE WIDTH (S) | DRIVE SQUARE CORNERS MAXIMUM | OPENING SQUARE WIDTH (O) | CONTACT RADIUS (R) | OPENING FLAT LENGTH (from center to contact area) (F) | TRANSITION SURFACE LENGTH (T) | CORNER RADIUS (C) | OPENING CORNER DIAMETER (D) |
|---|---|---|---|---|---|---|---|---|
| 1/4 | .2520/.2467 | 0.330 | .2603/.2527 | .2572/.2497 | .0872/.0847 | .0245/.0238 | 0.175/.0170 | .3550/.3446 |
| 3/8 | .3770/.3717 | 0.500 | .3853/.3777 | .3807/.3732 | .1291/.1266 | .0362/.0355 | .0259/.0254 | .5254/.5150 |
| 1/2 | .5020/.4967 | 0.665 | .5113/.5027 | .5052/.4967 | .1714/.1685 | .0481/.0473 | .0344/0.338 | .6972/.6855 |
| 3/4 | .7520/.7467 | 1.000 | .7613/.7527 | .7523/.7438 | .2552/.2523 | .0716/.0708 | .0512/.0506 | 1.0381/1.0264 |
| 1 | 1.0020/.9965 | 1.340 | 1.0125/1.0035 | 1.0005/.9916 | .3394/.3363 | .0952/.0944 | .0680/.0674 | 1.3807/1.3684 |
| 1 1/2 | 1.5030/1.4975 | 1.968 | 1.5155/1.5045 | 1.4975/1.4867 | .5079/.5043 | .1425/.1415 | .1018/.1011 | 2.0666/2.0516 |
| 2 1/2 | 2.5000/2.4845 | 3.344 | 2.5205/2.5045 | 2.4906/2.4748 | .8448/.8394 | .2370/.2355 | .1694/.1683 | 3.4370/3.4152 |
| 3 1/2 | 3.5000/3.4845 | 4.687 | 3.5205/3.5045 | 3.4788/3.4629 | 1.1800/1.1746 | .3311/.3296 | .2366/.2355 | 4.8007/4.7789 |

FIG-8

SOCKET WITH FOUR POINT DRIVE

CROSS-REFERENCE TO RELATED APPLICATIONS

This application claims priority to U.S. Provisional Application Ser. No. 61/794,415, filed Mar. 15, 2013, which is incorporated herein by reference in its entirety.

BACKGROUND OF THE INVENTION

Field of the Invention

This invention relates to sockets, and in particular to improvements in the drive end of sockets.

Discussion of the Prior Art

The first socket wrench was patented by J. J. Richardson in 1863 (U.S. Pat. No. 38,914). Early socket wrenches of this type were developed with square socket heads since hand filing was the typical method of manufacture in this era. However, with the advancement of modern manufacturing techniques, such as milling, shaping, broaching and die forging, sockets having hexagonal heads were developed and became more common. For over sixty years, sockets for hexagonal fasteners have been made having two styles of socket end openings, a six-point opening and a twelve-point opening, the latter being a double regular hexagon. Over this period, the dimensions of the sockets were standardized by the government and were adhered to by industry because the government was a major user of these tools and their standards were viewed as a measure of quality. The current leading standard that governs the socket end of socket wrenches is the American Society for Mechanical Engineers (ASME) standard B107.110-2012 (incorporated herein by reference in its entirety).

Although the standards for the socket ends are well established, they typically only govern the clearance and tolerance requirements for the various types of sockets, and do not control other design considerations, such as sharp inner corners that may act as stress risers leading to failure of the socket. Although early hexagonal sockets that were turned by hand did not usually have problems with failure at the corners, the introduction of higher strength fasteners and impact wrenches with enhanced torque loads resulted in more failures of sockets at the socket end. These failures were often caused by stress concentration of the increased loads at the sharp inner corners. Based on these and other considerations, a product known as the WrightDrive® was developed more than 25 years ago, and commonly assigned U.S. Pat. No. 4,882,957 (Wright et al. 1989) and U.S. Pat. No. 5,284,073 (Wright et al. 1994) were issued. These patents were directed to wrenches having fastener nut sockets with a plurality of uniformly spaced fastener corner clearance recesses disposed between the sides of the sockets and so designed for moving the torque loads away from the fastener corners to prevent rounding. Stress is thus distributed over a much larger area of the fastener, and leverage is improved while eliminating fastener rounding and increasing tool strength. Tool-to-fastener contact area of the Wright Drive® was found to be ten times greater than the conventional design.

In certain demanding industries, like aerospace, fasteners have gone from 60,000 psi tensile strength to over 180,000 psi tensile strength, and even more. As such, the demands on the sockets that are required to torque these fasteners have also increased. Spline sockets were introduced for turning both single and double-hexagonal fasteners in demanding applications where high torque is required. This is because a spline socket, unlike a hexagonal socket, does not tend to split the vector forces of the socket to generate non-productive radial forces. Thus, spline sockets have a reactant force vector that is parallel to the vector of force that drives the socket, resulting in more productive loads on the fastener, but which also results in greater stress on the socket body. Accordingly, spline sockets must typically be made from much stronger materials and have a higher hardness and tensile strength due to the requirement that they experience these greater loads. A typical spline socket may be made of a 4000-series steel, such as 4140, and have a hardness as high as 52 Rockwell C.

The greater resultant forces in spline sockets not only affect the socket end that engages the fastener, but the forces affect the drive end of the socket as well. Unlike the socket end of the socket, the drive end is governed by different industry standards, the leading standard being ASME B107.4-2005 (incorporated herein by reference in its entirety). This standard governs the tolerances and clearances for the drive end opening and corresponding drive anvil that engages the socket. However, the standard does not control design considerations such as sharp inside corners that may act as stress risers. Thus, prior art spline sockets have been known to fracture at the drive end, or in some instances explode due to the enhanced loads that they experience, which is caused by the increased stress concentration at the sharp inner corners of the drive end of the socket.

While the Wright Drive® improvement was very helpful for the socket end of a socket wrench, no one had previously considered a similar improvement to the drive end in the over 25 years that this improved design has been employed. More particularly, the drive end of sockets has not been improved in a similar manner in at least the 60 years since hexagonal sockets were developed. Thus, while engineered solutions to the socket end has resulted in thinner-walled, lighter-weight, less expensive, and longer life sockets, it is the drive end of sockets that needs improvements in order to satisfy the long-felt needs of the industry for a more robust and light-weight tool. The present invention satisfies these long-felt needs.

There are various differences between the socket end and the drive end of a socket. As already discussed, unlike the socket end, which has various configurations for the multitude of fastener-types to be engaged, the same drive end design is utilized over a broad range of socket types, including the hexagonal-type of the Wright Drive® design, but also in the more demanding spline socket designs, among others. Also as mentioned, the drive end of the socket is governed by different industry standards, having different tolerances and clearances with which engineered solutions must comply. In addition, the drive anvil (or drive square) that engages the socket is usually harder and stronger than the material composing the socket body, which can cause excessive wear and stress on the drive end of the socket that is receiving the torque load. This is especially the case where the sockets are being used with impact wrenches that deliver high torque output by storing energy in a rotating mass, such as a hammer, and which suddenly deliver the energy to the output shaft. These rapid, high-energy bursts can damage the socket at the drive end, and where these bursts of energy are repetitiously delivered at the stress-riser of a sharp corner, premature failure of the socket may occur.

Based on the shortcomings of the prior art, there exists a need for a socket having an improved drive end that can resist failure at the sharp inside corners of the opening in the drive end when the socket is experiencing high torque loads. Such a socket should comply with industry standards, and would preferably provide an engineered solution that minimizes overall socket wall thickness and the expense of manufacturing the socket. High quality sockets, particularly those spline sockets of a large size, can be very expensive. Currently, such sockets have a market price going up to $10,000. Therefore, improvements in these sockets would not only increase work productivity, but would also reduce the need to purchase new and very expensive tools.

SUMMARY OF THE INVENTION

The present invention satisfies the various long-felt, yet unsatisfied needs in the art of sockets through the provision of a socket comprising a drive end portion having an opening being so dimensioned for receiving a drive anvil, the opening comprising a plurality of bounding surfaces parallel to a central axis and being disposed in diametrically opposed pairs about the axis, where the diametrically opposed pairs of bounding surfaces include: at least two pairs of flat side surfaces being parallel to each other about the central axis; at least two pairs of curved recess surfaces forming respective inner corners of the drive end opening; and adjacent pairs of outwardly diverging transition surfaces transitioning between respectively adjacent pairs of the flat side surfaces and the curved recess surfaces.

Another aspect of the invention relates to a provision wherein each of the transition surfaces of the opening respectively comprise a contact surface and an angled divergence surface. The contact surfaces may be operatively joined to the respective flat side surfaces at contact transition areas, wherein the contact surfaces provide mating surfaces for the drive anvil side portions to engage the contact surfaces for distributing force over a larger contact area. The angled divergence surfaces may transition between the respective contact surfaces and respective curved recess surfaces, the angled divergence surfaces operatively joining the curved recess surfaces at a corner transition area, wherein the angled divergence surfaces may diverge outwardly at a divergence angle for providing clearance with respective drive anvil corner portions, which may locate the forces away from said respective inner corners.

Yet another aspect of the invention pertains to a provision wherein the respective contact surfaces are outwardly diverging arcuate contact surfaces, each being defined by a contact radius having a radial position perpendicular to respective contact transition areas. The contact transition areas may be so dimensioned or so located according to the locations where the drive anvil side portions engage the contact surfaces proximal to the respective flat side surfaces when the drive anvil is rotated in a forward or reverse direction about the central axis.

In another aspect of the invention, a provision is provided wherein the curved recess surfaces comprise adjacent pairs of arcuate recess surfaces being disposed on opposite sides of a curved corner apex surface. The curved corner apex surface may be defined by an opening corner diameter, which may be the diameter of the circle that inscribes the inner corners of the drive end opening. The arcuate recess surfaces may each be defined by a corner radius provided for minimizing stress concentration at the inner corners.

Still another aspect of the invention relates to a provision wherein the drive end opening is a generally square-shaped opening, having exactly two pairs of diametrically opposed flat side surfaces being parallel to each other about the central axis, and having exactly two pairs of diametrically opposed curved recess surfaces which are joined to respective flat side surfaces by respectively adjacent pairs of outwardly diverging transition surfaces.

In another provision of the invention, a square-shaped opening in the drive end includes a side-to-side dimension being defined by the distance between diametrically opposed pairs of flat side surfaces, the opening side-to-side width being so dimensioned according to an industry standard for receiving a drive anvil, wherein the drive anvil also has a side-to-side dimension measured between its flat sides that is so dimensioned according to the same industry standard.

Still yet another aspect of the invention includes provisions having specific, but non-limiting, ranges of dimensions for practicing the invention according to industry standard square dimensions. Such specific dimensions may be provided in English units, however, other similar provisions of the invention may be provided on a metric scale by converting the English units (in inches) to millimeters.

Through the provisions and embodiments discussed herein, it is a general object of the invention to improve the drive end of sockets for preventing failure of the socket during a torque application, where failure may include plastic deformation or fracture.

It is another object of the present invention to provide a drive end opening having curved recess surfaces at its inner corners to reduce stress concentration in those areas.

Yet another object of the invention is to distribute stress evenly across the surfaces of the drive end opening for improving the life and minimizing the likelihood of failure. Another object of the invention is to prevent rounding and wear of the corners of the drive anvil, which is also an expensive article to replace.

Still another object of the present invention is to relocate the maximum stress concentration away from the inner corners of the drive end opening, and to distribute the stress over a larger contact area than ordinary sockets. A more specific object of an embodiment of the invention is to reduce the stress concentration to minimize or prevent plastic deformation and/or fracture at the inner corners of the drive end opening.

It is another object of the invention to provide a drive end opening that will allow for greater surface contact with the drive anvil sides and which will minimize the stress concentration away from the inner corners. In an embodiment of the invention, a greater contact area away from the inner corners may be achieved by providing contact surfaces in the drive end opening that mate with the drive anvil side portions, wherein the contact surfaces are outwardly diverging arcuate contact surfaces that provide a smooth transition between flat side surfaces and angled divergence surfaces. Another object of an embodiment of the invention is to provide such contact surfaces for development of mating surfaces where the drive anvil and socket opening surfaces wear against each other over time. A more specific object of an embodiment of the invention is to provide such contact surfaces for extending the life of the socket and/or anvil, particularly where the socket is an impact socket for use with an impact wrench that repetitiously hammers the socket during the torque application.

Still another object of the present invention is to provide an engineered solution to improve the drive end of sockets for preventing failure of the socket, while also minimizing drive wall thickness at the drive end. Such a socket could reduce overall material and manufacturing costs associated with sockets, as well as provide for a lighter weight socket that is easier to wield.

Another object of an embodiment of the invention is to improve the drive end of spline sockets that experience enhanced forces and greater stress concentrations compared to other socket designs, and which may be more likely to fracture due to being harder and having less ductility than other sockets.

It is another general object of the present invention to provide an engineered improvement to the opening in the drive end of a socket that complies with leading industry standards governing the drive end of sockets. A more specific object of an embodiment of the invention is to provide an engineered socket having close tolerances with the drive anvil, and that also complies with industry standards.

These and other objects should be apparent from the description to follow and from the appended claims.

BRIEF DESCRIPTION OF THE DRAWINGS

The present invention may take physical form in certain parts and arrangement of parts, the preferred embodiments of which will be described in detail in the specification and illustrated in the accompanying drawings which form a part hereof, and wherein:

FIG. 8 is a table showing maximum and minimum values (in inches) of various dimensions for several standard square sizes (in fractional English units) according to preferred embodiments of the invention.

DETAILED DESCRIPTION OF THE PREFERRED EMBODIMENTS

Figure 1:
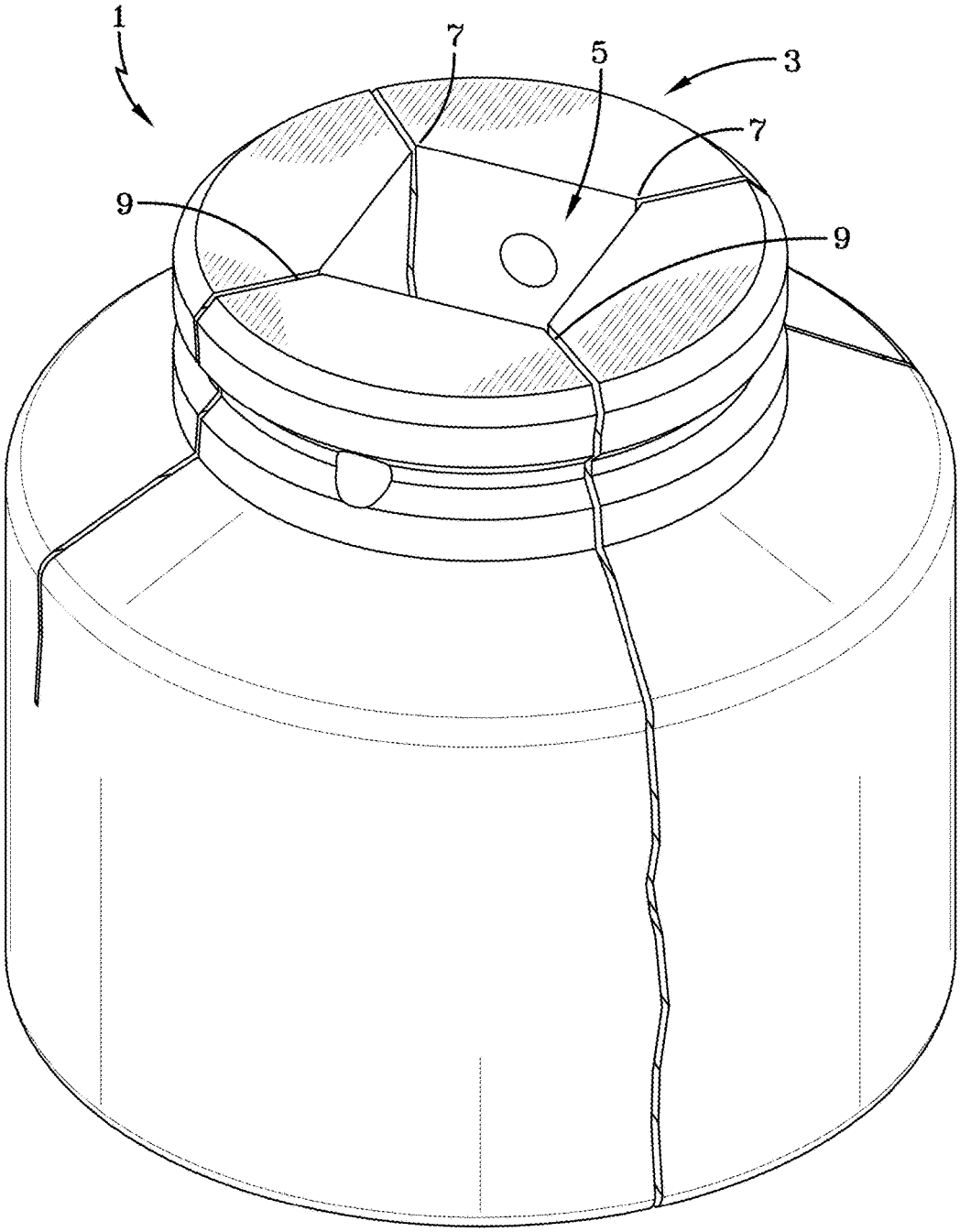
FIG-1 PRIOR ART
FIG. 1 is a perspective view of a prior art socket depicting failure at the sharp inner corners.

As explained in the background of the invention, the inside corners in the drive end opening of sockets have heretofore been sharp corners which results in stress risers at those corners. When high torque loads are applied to the drive end of a socket, the stress concentrated at these inner corners may exceed the yield strength or tensile strength of the socket material leading to failure, which can include plastic deformation or fracture. A schematic diagram of a prior art spline socket 1 illustrating fractures 9 at the sharp inside corners 7 of a drive end opening 5 are depicted in FIG. 1. These types of fractures 9 at the drive end 3 of prior art sockets are well known, particularly with respect to spline sockets that experience enhanced loading due to the particular distribution of forces in a spline socket torque application.

Figure 2:
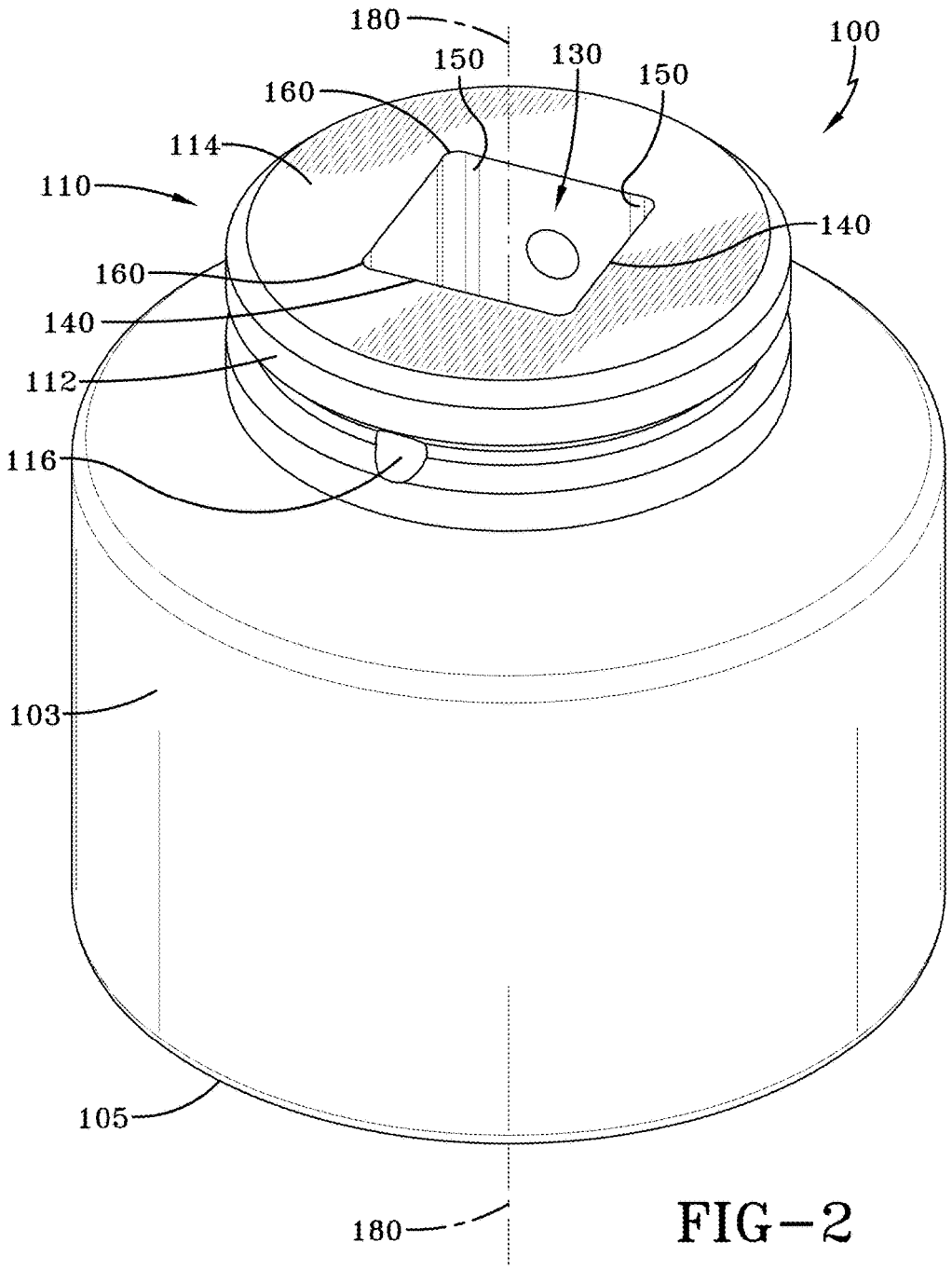
FIG. 2 is a perspective view of a socket according to a preferred embodiment of the invention.

The present invention is directed toward improving the opening in the drive end of sockets for preventing failure of the socket during a torque application. A socket 100 according to an embodiment of the invention is shown in FIG. 2. Socket 100 comprises an elongated body portion 103 located between a socket end portion 105 and a drive end portion 110. As shown in FIG. 2, socket elongated body portion 103 may be a cylindrical body having an exterior surface and an interior surface that defines a socket cavity (not shown). The distance between elongated body portion 103 exterior surface and interior surface (not shown) is known as a socket wall thickness. In preferred embodiments, it is beneficial to maintain as thin a socket wall thickness as possible to reduce the costs associated with the socket, as well as minimize the weight for wielding the socket. The socket wall thickness may preferably be between 0.020 in. and 0.750 in., and may more preferably be between 0.050 in. and 0.250 in. Socket end portion 105 may comprise a socket opening (not shown) that is configured as a six-point hexagonal opening, or a twelve-point double regular hexagonal opening, for receiving the head of a fastener. However, the present invention is not limited to hexagonally-shaped socket openings, and may be used with sockets having various socket opening configurations, including symmetrical spline sockets, asymmetrical spline sockets, square openings, triple-square openings, and the like.

In preferred embodiments of the invention, the socket is made of a 4000-series alloy steel, and more preferably the alloy is selected from the group consisting of: 4140, 4047, and 4340. The socket material may be forged and heat treated to achieve the required hardness and strength for a particular application. In some embodiments, the hardness of the socket is in the range between 36 and 48 Rockwell C (HRC). However, for certain spline socket applications where the socket experiences enhanced loading, the socket material may have a hardness as high as 52 HRC.

Still referring to FIG. 2, socket 100 drive end portion 110 may also comprise a drive end body portion 112. As shown in the embodiment of FIG. 2, drive end body portion 112 may be a cylindrical body having a smaller outer diameter than socket elongated body portion 103. As described in greater detail below, drive end portion 110 also includes a driVe end opening 130 with bounding side surfaces forming an inner hollow, acrd the distance between the exterior of drive end body portion 112 and the inner hollow defines a drive wall thickness. According to an object of the invention, minimizing the drive wall thickness could help to reduce material costs and improve weight savings compared to a socket having a thicker drive wall thickness, which may otherwise be required for preventing failure in applications having higher stress loading. However, in other embodiments of the invention, drive end body portion 112 may have the same outer diameter as socket elongated body portion 103 for forming a substantially continuous exterior body portion having a uniform outer diameter from socket end portion 105 to drive end portion 110. Drive end body portion 112 may also comprise a detent receiving hole 116 for receiving a detent protrusion of a drive anvil or drive axle (not shown) that may be inserted into socket 100.

Figure 3:
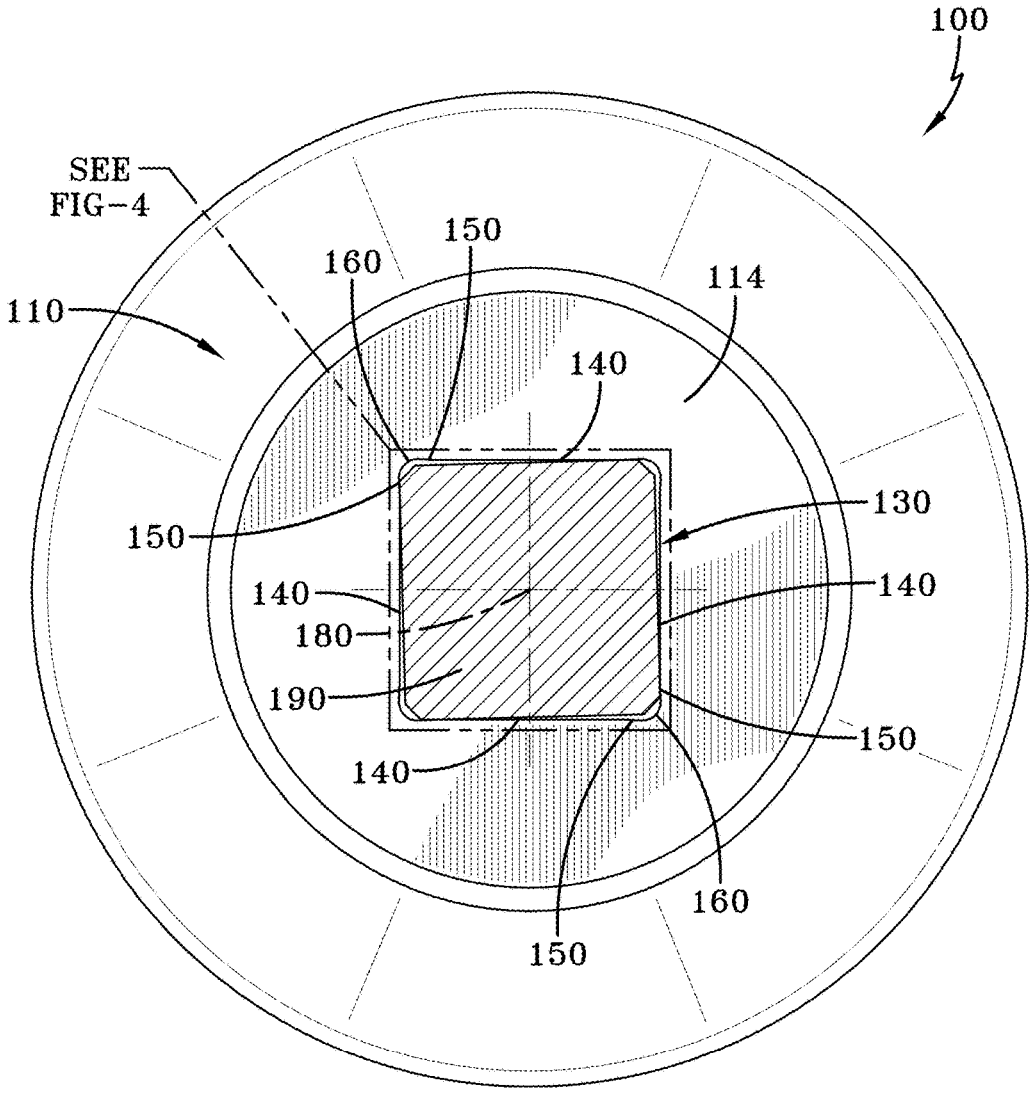
FIG. 3 is an end view of the socket of FIG. 2.
Figure 4:
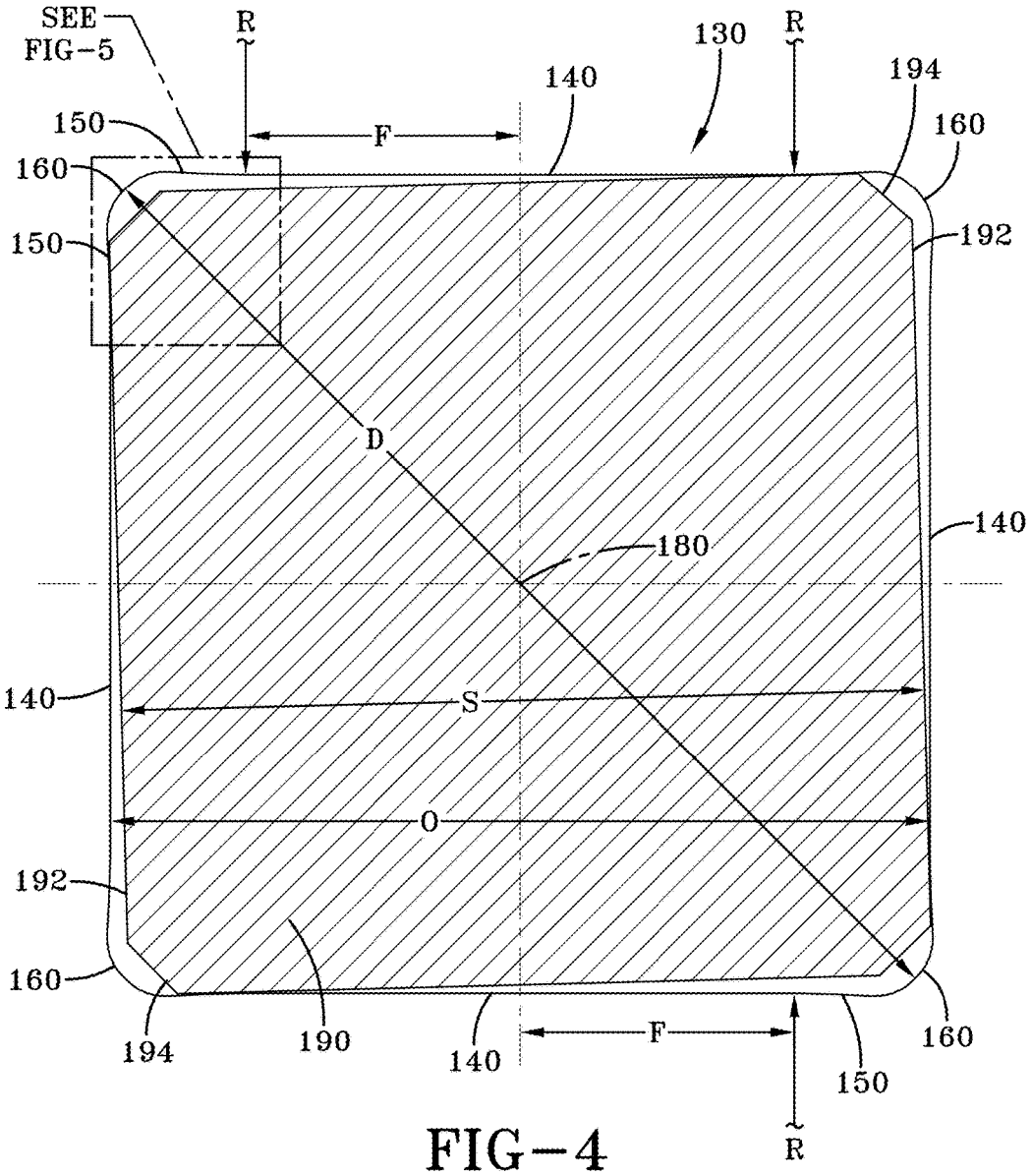
FIG. 4 is an enlarged view of a portion of the socket shown in FIG. 2.

As shown in FIGS. 2-4, drive end portion 110 comprises a drive end surface 114 having opening 130. Opening 130 comprises a plurality of bounding surfaces that are parallel to a central axis 180, including flat side surfaces 140, outwardly diverging transition surfaces 150, and curved recess surfaces 160. Flat side surfaces 140 do not extend to curved recess surfaces 160, but diverge from being flat as explained below. The plurality of bounding surfaces are disposed in diametrically opposed pairs about the central axis 180, which forms a symmetry of the bounding surfaces about the central 180. As shown in the embodiment of FIGS. 2-4, opening 130 comprises two pairs of flat side surfaces 140 being parallel to each other about the central axis 180 for forming a generally square-shaped opening 130. The inner corners of opening 130 are formed by two pairs of curved recess surfaces 160, which are operatively joined to respective flat side surfaces 140 by respectively adjacent pairs of outwardly diverging transition surfaces 150. As used herein, the term "adjacent" does not connote that such surfaces need to be directly or immediately adjacent to each other; rather, adjacency connotes surfaces that have a common inner corner. It should be understood that although the drive end opening 130 is shown as having a generally square-shape, the present invention could be practiced with a drive end opening having any even numbered pair of respective bounding surfaces greater than two.

Figure 5:
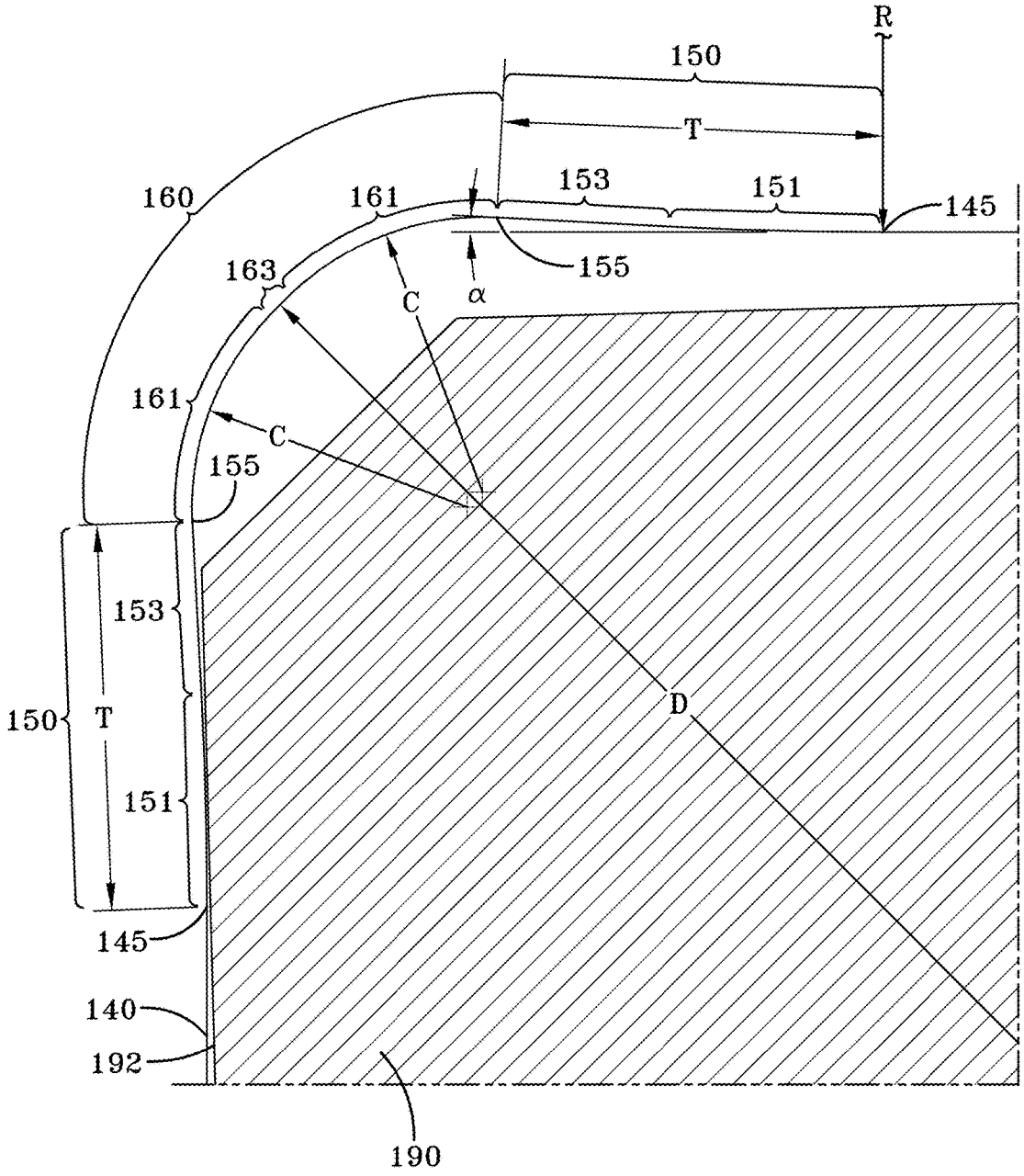
FIG. 5 is an enlarged view of a portion of the socket shown in FIG. 4.

According to an object of the invention, opening 130 may be so dimensioned for receiving a drive anvil 190, as shown in FIGS. 3-5. As shown, drive anvil 190 may have a generally square-shape, including drive anvil side portions 192 and drive anvil corner portions 194 (shown as chamfered, but which may also be a break or rounded, and which may comprise portions of drive anvil sides 192). In preferred embodiments, drive anvil 190 complies with the requirements for standard-sized drive anvils (or drive squares) according to ASME B107.4-2005, including the critical dimensions and tolerances thereof. Accordingly, in preferred embodiments of the invention, opening 130, having a generally square-shape as shown in FIGS. 2-5, will also comply with the requirements for drive end openings according to ASME B107.4-2005, including its critical dimensions and tolerances. Based on these and other considerations, some of the critical dimensions for preferred embodiments of the invention may be found in the table of FIG. 8, which lists the standard square sizes (in fractional English units) according to ASME B107.4-2005. However, not all of the dimensions listed in the table of FIG. 8 are considered critical dimensions, either according to ASME B107.4-2005 or the present invention. As illustrated in FIG. 4 and listed in FIG. 8, the critical dimensions include a drive square width (or anvil side-to-side dimension) (S), an opening square width (or opening side-to-side dimension) (O), and a drive square corners maximum (not shown). The drive square corners maximum may be defined as the maximum diameter of the circle that inscribes a drive square at its maximum side-to-side width (S). It is common for drive anvils to be near the maximum dimensions for increasing the lever arm to increase torque capacity at a given force. Thus, the drive square corners maximum may typically be between about 0.005 in. and 0.015 in. below the maximum value. Unless otherwise stated, the values listed in the table of FIG. 8 represent maximum and minimum dimensions (in inches and forming a range thereof), and a nominal value may be considered the mean value of the range.

In preferred embodiments, the present invention complies with the requirements of ASME B107.4-2005. The general requirement for drive end openings according to ASME B107.4-2005 is that the drive end opening has sufficient clearance about its bounding surfaces for a standard-sized drive anvil (GO-NO GO gauge) to be inserted into the opening. As such, the dimensions of preferred embodiments of the invention, including the outwardly diverging transition surfaces and the curved recess surfaces, should comply with this general requirement. FIGS. 4-5 illustrate some of the important dimensions of drive end opening 130 according to a preferred embodiment of the invention. As previously mentioned, a critical dimension for drive end opening 130 according to preferred embodiments is the opening side-to-side dimension (O), which is measured between diametrically opposed flat side surfaces 140. As shown in FIG. 4-5, flat side surfaces 140 may have a flat side dimension or length (F), which is measured from the center or midpoint of flat side surface 140 to a contact transition area 145 where flat side surface 140 operatively joins transition surface 150.

Also as shown in the embodiment of FIGS. 4-5, each transition surface 150 comprises a contact surface 151 and an angled divergence surface 153. As shown, contact surface 151 is the portion of transition surface 150 that operatively joins flat side surface 140 at contact transition area 145. Each respective contact transition area 145 may be so located according to the positions where drive anvil side portions 192 engage contact surfaces 151 proximal to respective flat side surfaces 140 when the drive anvil 190 is rotated in a forward or reverse direction about the central axis 180. In other words, contact transition area 145 can be determined by disposing a standard-sized and critically dimensioned drive anvil inside of a standard-sized and critically dimensioned drive end opening, both having a common central axis, and rotating the drive anvil in a clockwise and counterclockwise direction until the anvil contacts (or intersects with) the contact surfaces. Such a method for determining the contact transition area can be easily achieved using a CAD program. Since the drive anvil could engage the contact surfaces in either the forward or reverse directions of rotation, there may be a total of eight contact transition areas 145, as shown.

In a preferred embodiment, contact surfaces 151 are outwardly diverging arcuate contact surfaces, each having its convex side proximal to opening 130. As shown in the embodiment of FIGS. 4-5, each arcuate contact surface 151 may be defined by a contact radius (R) having a radial position perpendicular to respective contact transition area 145. In this manner, arcuate contact surface 151 extends from contact transition area 145 in an arc defined by contact radius (R) until contact surface 151 transitions into angled divergence surface 153. As shown, contact radius (R) may be a relatively large radius (greater than 10 times a corner radius (C), described below), which may provide for a gradual transition between flat side surface 140 and angled divergence surface 153, and which may also provide an enhanced mating surface with drive anvil side portion 192.

Also as shown in the embodiments of FIGS. 4-5, each transition surface 150 comprises angled divergence surface 153 that operates as the transition surface between contact surface 151 and curved recess surface 160. As shown in the embodiment, angled divergence surface 153 diverges outwardly by a divergence angle ($\alpha$), which is measured between angled divergence surface 153 and the continuum of the plane that defines flat side surface 140. Angled divergence surface 153 extends from its transition with contact surface 151 to a corner transition area 155 where it is operatively joined with curved recess surface 160. In this manner, a length (T) of the overall transition surface 150 may be defined by the distance between contact transition area 145 and corner transition area 155. It should be understood that the selected values of divergence angle ($\alpha$), contact radius (R), and location of contact transition area 145 may determine the transition surface length (T), which can affect the dimensions of curved recess surface 160 (described below). In preferred embodiments, the transition surface length (T) and divergence angle ($\alpha$) are so dimensioned for providing a smooth transition between transition surface 150 and curved recess surface 160, while also maximizing corner radius (C) and without detracting from the overall usefulness of the socket. In certain preferred embodiments, divergence angle (α) is between about 2 to 5 degrees, and most preferably about 3 degrees.

Still referring to FIGS. 4-5, respective curved recess surfaces 160 form inner corners of opening 130. In a preferred embodiment, each curved recess surface 160 comprises a pair of adjacent arcuate recess surfaces 161 being disposed on opposite ends of a curved apex surface 163. Each respective curved corner apex surface 163 may be defined by an opening corner diameter (D), which is the diameter of the circle that can inscribe the inner corners of opening 130 at the curved apex surfaces 163. Also as shown in FIG. 5, arcuate recess surfaces 161 may be defined by a corner radius (C) which arcs between corner transition area 155 and curved apex surface 163. In this manner, the portion of each arcuate recess surface 161 that is distal from curved apex surface 163 join angled divergence surface 153 at corner transition area 155.

It should be understood that outwardly diverging transition surfaces 150 and curved recess surfaces 160 provide several important advantages for improving the drive end of sockets according to an object of the present invention. For example, as previously mentioned, providing a pair of outwardly diverging transition surfaces 150 with lengths (T) allows for curved recess surfaces 160 to smoothly transition with transition surfaces 150, while maximizing inner corner radius (C). Unlike prior art sockets having sharp inner corners at the drive end opening, a larger inner corner radius (C) according to an object of the present invention minimizes stress concentration at the corners, which can help to prevent failure. Having a larger inner corner radius (C) according to an embodiment of the invention is particularly important for socket bodies having higher hardness, such as spline sockets, since the reduced ductility of these sockets may not adequately blunt a propagating crack tip, which can lead to catastrophic fracture. Thus, minimizing the stress concentrated at the inner corners, and evenly distributing the stress over a larger corner area to prevent plastic deformation, or even crack initiation, is one way in which an object of the present invention is achieved. In addition, embodiments of the present invention operate to relocate the maximum stress concentration away from the inner corners where failure is most likely to occur. According to an object of the invention, this can be achieved by locating contact surfaces 151 away from inner corners, and by providing angled divergence surfaces 153 that diverge away from contact with drive anvil corner portions 194. In this manner, contact surfaces 151 that are engaged by drive anvil side portions 192 provide a larger area for stress to be distributed over, and the clearance provided by angled divergence surfaces 153 further minimizes stress concentration near the inner corners. In a preferred embodiment, the provision of contact surface 151 being an outwardly diverging arcuate surface further enhances the smooth transition between respective surfaces and the resulting distribution of stresses.

Figure 6:
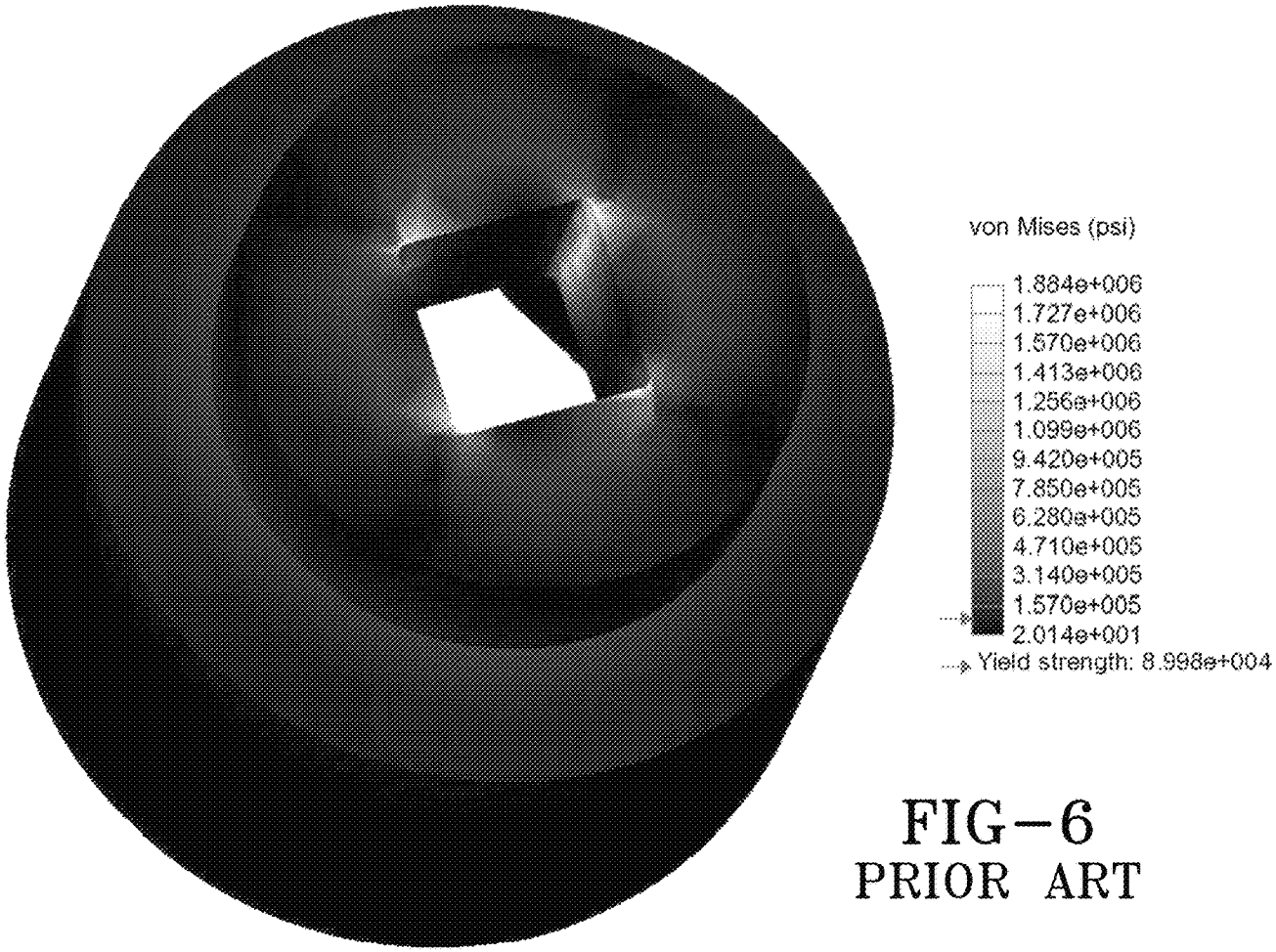
FIG–6 PRIOR ART
FIG. 6 is a finite element analysis plot of a prior art socket.
Figure 7:
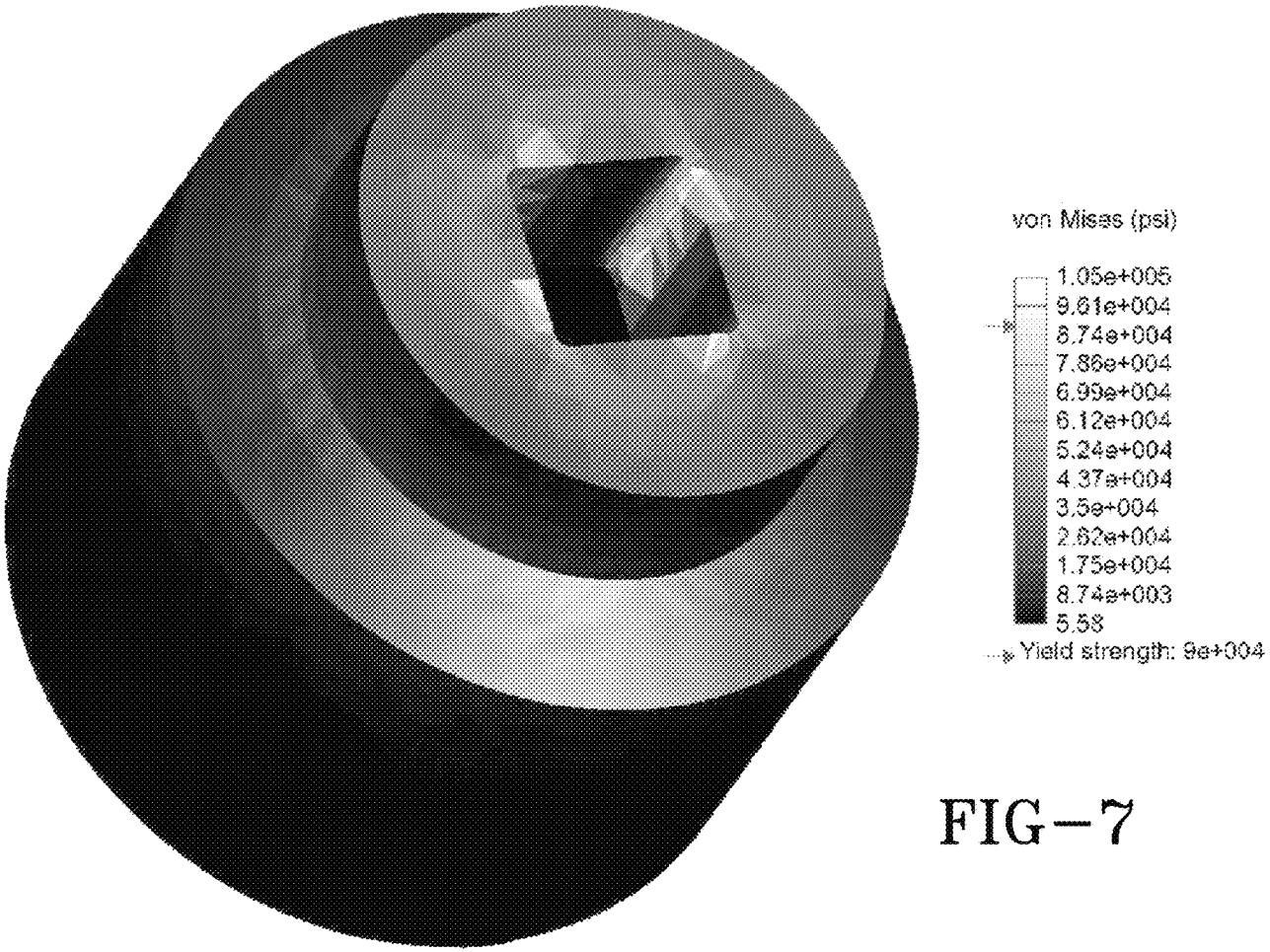
FIG. 7 is a finite element analysis plot of a socket according to a preferred embodiment of the invention.

The foregoing features according to an embodiment of the invention were compared to a prior art socket through finite element analysis (FEA). Turning to FIG. 6, an FEA plot of a prior art socket (a computer-made simulation of a prior art socket) having sharp inner corners is shown. According to the FEA simulation, the prior art socket of FIG. 6 has its maximum stress intensity concentrated at the inner corners, which is indicated by the white areas in the diagram. The results of the FEA simulation indicate that the maximum stress intensity of the prior art socket is about $1.88\times10^5$ psi, which exceeds the yield strength of the socket material of this example by about 20×. Turning to FIG. 7, an FEA plot of a socket (also a computer-made simulation) according to an embodiment of the present invention is shown. As seen in FIG. 7, the socket of the present invention has areas of maximum stress intensity that are located away from the inner corners, and the stress is distributed over the contact surfaces, as previously described. Moreover, the results of the PEA simulation for the socket of FIG. 7 indicates that stresses are distributed over a larger area, resulting in a maximum stress intensity of only $1.05\times10^6$ psi. Therefore, the results of this analysis indicate that the socket according to a preferred embodiment of the invention has reduced the maximum stress intensity by more than 10× over the prior art socket.

By minimizing stress concentration at the corners, distributing stress over a larger area, and relocating the areas of maximum stress, the present invention also allows for the socket to be engineered with minimal drive wall thickness, which can reduce material and manufacturing costs associated with the socket, as well as reduce the weight of the socket to benefit the end user. In addition, it is well known that sockets and drive anvils will wear over time, particularly with impact wrench applications. Thus, another object of an embodiment of the invention is to provide mating surfaces between the drive anvil side portions 192 and contact surfaces 151 that may extend the life of the socket and/or drive anvil as each member wears against each other over time. According to an embodiment of the invention, outwardly diverging arcuate contact surfaces 151 and angled divergence surfaces 153 having a divergence angle (α) of at least 2 degrees could improve the life of each member as they wear. In this manner, contact surfaces 151 may become larger over time and consume a portion of angled divergence surface 153. Accordingly, the selection of contact radius (R) and divergence angle (α) not only impact the length of transition surface (T) and corner radius (C), but may also have an impact on how stresses are distributed over the life of the socket.

Another object according to preferred embodiments of the invention is to provide an improved drive end that conforms to industry standard sockets. Based on this consideration, and in light of the foregoing aspects of the present invention, a series of specific, but non-limiting dimensions according to preferred embodiments of the invention may be found in the table of FIG. 8. As mentioned previously, the critical dimensions for each standard square size may be found in ASME B107.4-2005, and include the dimensions of drive square width (S), opening square width (O), and drive square corners maximum. According to aspects of the invention, the remaining dimensions in the table were determined based on the foregoing discussion and with a divergence angle of 3 degrees. Unless otherwise stated, the values in the table represent minimum and maximum dimensions (in inches and forming a range thereof), with a nominal dimension representing the mean of the range. Based on the values in the table of FIG. 8, preferred, but non-limiting, embodiments of the invention that could achieve the various objects discussed above could be made. Of course, the same dimensions provided in the table of FIG. 8 could be used for determining the equivalent standard-sized metric socket squares, or variations thereof, by converting the values in the table from inches to millimeters by dividing each number by 25.4. Likewise, sockets having non-standard sized squares could also be made according to the invention by using the table of FIG. 8 as a guide and scaling proportionally.

The invention has been described in detail with particular reference to the preferred embodiments thereof, with variations and modifications which may occur to those skilled in the art to which the invention pertains.

What is claimed is:

1. A socket for a wrench, the wrench for being turned by a four-sided drive anvil for engaging and turning said socket about a central axis with a force, said four-sided drive anvil having four anvil drive surfaces and defining in cross section a square, said socket comprising a drive end portion having a drive end opening being so dimensioned for receiving the four-sided drive anvil, said drive end opening being defined by four bounding surfaces of equal length and being both parallel to said central axis and disposed in two diametrically opposed pairs about said central axis for preventing failure of the socket during a torque application to said drive end portion and to prevent rounding and wear of the corners of the four-sided drive anvil to extend the life of the socket and/or anvil, said diametrically opposed pairs of bounding surfaces including:

two pairs of flat side surfaces being parallel to each other about said central axis, said two pairs of flat side surfaces forming an intermediate part of said respective bounding surfaces;

two pairs of curved recess surfaces forming respective four inner corners of said drive end opening; and four adjacent pairs of outwardly diverging transition surfaces transitioning between respectively adjacent pairs of said flat side surfaces and said curved recess surfaces, wherein each of said respective outwardly diverging transition surfaces comprise:

a contact surface being operatively joined to said respective flat side surfaces at a location defined by a contact transition area, said respective contact surfaces providing mating surfaces with respective drive anvil side portions that engage said contact surfaces for distributing the force over said contact surfaces; and an angled divergence surface transitioning between each of said respective contact surfaces and said respective curved recess surfaces, each of said respective angled divergence surfaces being operatively joined to each of said respective curved recess surfaces at a location defined by a corner transition area, said respective angled divergence surfaces providing clearance with respective drive anvil corner portions for locating the force away from said respective inner corners;

wherein each of said respective contact surfaces are outwardly diverging arcuate contact surfaces being defined by a contact radius, said contact radius having a radial position perpendicular to said respective contact transition areas;

wherein each of said respective angled divergence surfaces diverge outwardly at a divergence angle being defined by the angle between said angled divergence surface and an imaginary plane that is the continuum of the plane defining said respective flat side surface;

wherein each of said respective curved recess surfaces have a curved corner apex surface, and each of said respective curved recess surfaces comprise two pairs of adjacent arcuate recess surfaces being disposed on opposite sides of said respective curved corner apex surfaces, each of said respective two pairs of arcuate recess surfaces transitioning between said curved corner apex surface and said respective angled divergence surfaces, wherein said respective two pairs of arcuate recess surfaces are defined by a corner radius;

and wherein said contact radius defining each of said respective contact surfaces is at least 10 times greater than said corner radius for providing enhanced mating surfaces for the drive anvil side portions to engage said arcuate contact surfaces; and wherein said divergence angle is in the range between about 2 to 5 degrees.

* * * * *